United States Patent [19]

Maeda et al.

[11] Patent Number: 4,669,534

[45] Date of Patent: Jun. 2, 1987

[54] AIR CONDITIONER

[75] Inventors: Hideo Maeda, Ashikaga; Tadashi Hori, Ohta; Tatsuya Tani, Tatebayashi, all of Japan

[73] Assignee: Sanyo Electric Co., Ltd., Moriguchi, Japan

[21] Appl. No.: 880,314

[22] Filed: Jun. 30, 1986

[30] Foreign Application Priority Data

Jul. 1, 1985 [JP] Japan ..... 60-100281

[51] Int. Cl.[4] ..... F24F 7/00

[52] U.S. Cl. ..... 165/59; 62/262; 98/94.2

[58] Field of Search ..... 98/94.2; 62/262; 165/59, 61, 65, 122; 219/368, 369, 366

[56] References Cited

FOREIGN PATENT DOCUMENTS 57-47634 10/1982 Japan .

*Primary Examiner*—Henry A. Bennett

*Attorney, Agent, or Firm*—Wenderoth, Lind & Ponack

[57] ABSTRACT

A room air conditioner of a window mounted unit type having an air inlet grill and an air outlet grill on a front panel of the air conditioner. The air conditioner has a blower, a heat exchanger and an air passage directing an air flow from the blower to the heat exchanger, and an air guide arrangement in the air passage. The air guide arrangement guides the air flow from the blower to the heat exchanger in a uniform manner to minimize deviation of air flow distribution in the air passage to the heat exchanger.

4 Claims, 10 Drawing Figures

AIR CONDITIONER

BACKGROUND OF THE INVENTION

The present invention relates in general to an air conditioner, and more particularly to a window mounted unit type air conditioner having an air inlet grill and an air outlet grill on a front panel of the air conditioner.

The air conditioner of the type as described above is shown in, for example, Japanese Utility Model Publication No. 57-47634, published Oct. 19, 1982. The conventional air conditioner disclosed in this publication has an air inlet grill and an air outlet grill on its front panel, a fan casing having a blower, at an air downstream of the inlet grill, and a heat exchanger at an upstream of the outlet grill so that air flow discharged out of the casing is directed to an air passage and then to the heat exchanger. The room air is heat-exchanged by the heat exchanger and then discharged out of the outlet grill. In the conventional air conditioner described above, the air passage is curved or bent at about right angles between the casing and the heat exchanger, and this structure provides a serious disadvantage that air flows substantially along a wall surface of larger curvature rather than along a wall surface of smaller curvature, resulting in a defective deviation of air flow distribution within the air passage in the air conditioner.

SUMMARY OF THE INVENTION

A general object of the present invention is to provide an improvement in air flow distribution in the air passage within the air conditioner.

Another object of the present invention is to provide an improved air conditioner which permits uniform distrubition of temperature of a heat exchanger, and improvement in efficiency of air conditioning.

A further object of the present invention is to provide a small-sized air conditioner.

Another object of the present invention is to provide an improved air conditioner which permits a uniformity of heating temperature and prevents the outlet grill from being thermally deformed due to local overheating due to deviation of air flow distribution Briefly, the air conditioner according to the pressent invention comprises a blower, a heat exchanger and an air passage directing an air flow from the blower toward the heat exchanger, and an air guide arrangement in the air passage. The air guide guides the air flow from the blower to the heat exchanger in a uniform manner to minimize deviation of air flow distribution in the air passage within the air conditioner.

The air conditioner according to the present invention comprises various components of an air conditioning, such as blower, temperature regulating heat exchanger and electric heater. The heat exchanger is located along an inner surface of the outlet grill which is disposed on a side wall of the air conditioning unit. At the back of the heat exchanger, a flat member or a partition is disposed for guiding and directing air flow discharged from the blower towards the heat exchanger so that the air passage is formed by the combination of the partition and the heat exchanger. The air guide disposed in the air passage has a front blade which has a front end located at a central portion of the air passage and projecting towards an electric heater and a rear end which projects along the air flowing direction and approaches against the partition, and a rear blade which extends from the front blade transversely to the air passage towards the heat exchanger in an inclined relation relative to the partition such that a distance between the rear blade and the partition becomes larger as the rear blade extends towards the heat exchanger. In the air passage between the air guide and the blower, an electric heater is disposed for heating the air discharged by the blower. Preferably, the blower is a centrifugal blower and the electric heater is positioned in the air passage behind fins of the heat exchanger in an abutment relation.

PREFERRED EMBODIMENTS OF THE INVENTION

Figure 1:
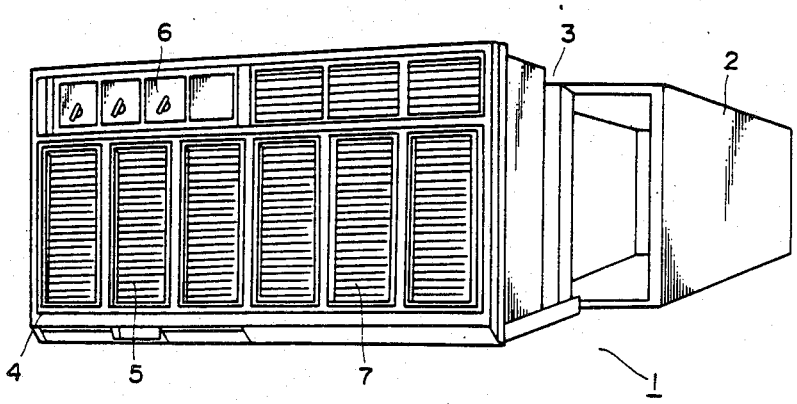
FIG. 1 is a perspective view, partly fragmented, of an air conditioner according to the present invention.

Referring first to FIG. 1, a window mounted unit type air conditioner 1 for cooling and heating operations has a housing 2, air conditioning unit 3 in the housing 2 and a front panel 4 releasably attached to the housing 2. The front panel 4 has an inlet grill 5 and an operation panel portion 6 on one side and an exit opening or an outlet grill 7 on the other side.

Figure 2:
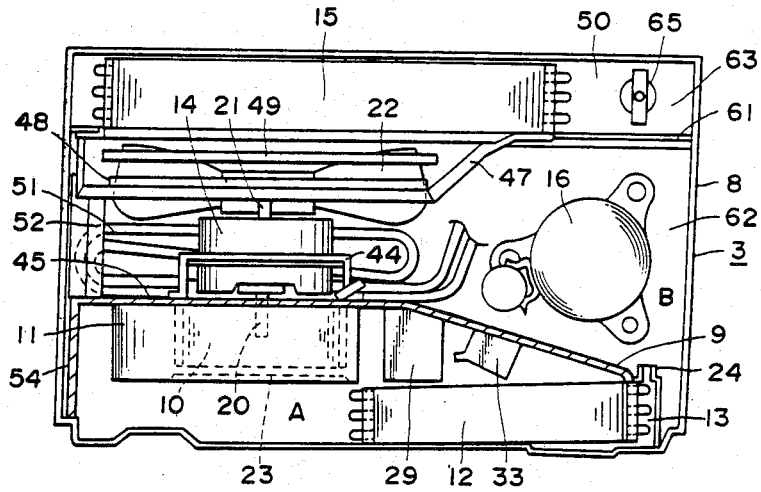
FIG. 2 is a top plan view of an air conditioner unit embodying the present invention, with a top wall of a housing being removed.

In FIG. 2, the air conditioning unit 3 is divided into two sections, that is, an inside air compartment A and an outside air compartment B by a flat member or a partition 9 which is fixed to a base 8 of the unit 3. In the inside air compartment A a centrifugal blower 10, such as Sirocco fan, a fan casing 11 of the blower 10, an inside heat exchanger 12 and a drain pan 13 are disposed, and in the outside air compartment B a fan motor 14, an outside heat exchanger 15 and a refrigerant compressor 16 are disposed.

Figure 3:
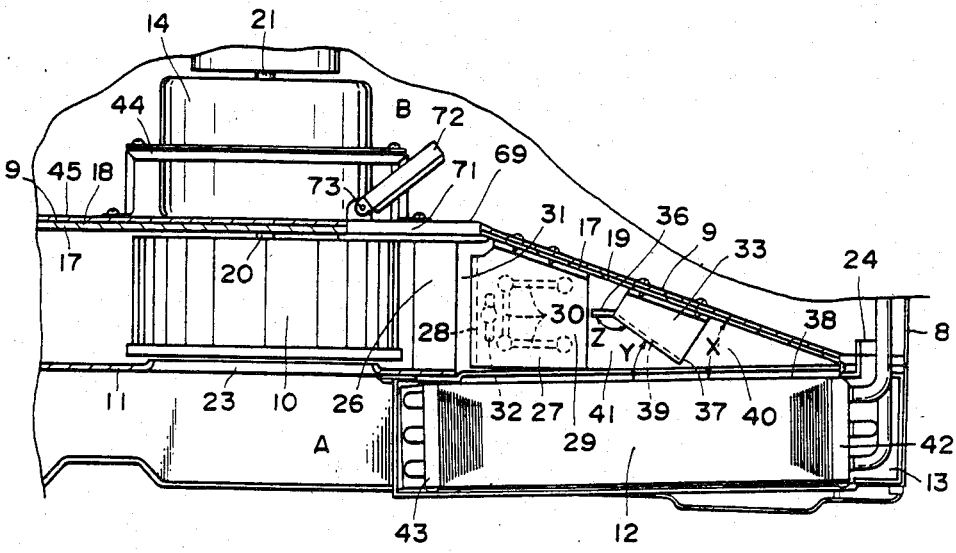
FIG. 3 is a partly cut-out, enlarged plan view of the air conditioning unit shown in FIG. 2.

As shown in FIG. 3, the partition 9 has an heat insulating materials 17 adhered on its surface exposed to the inside air compartment A. An opening 69 connects the inside air compartment A and the outside air compartment B together. A mounting member 71 of a damper 72 presses the heat insulating materials 17 against the partition 9. The damper 72 rotates about a supporting axis 73 and open and close the opening 69. The fan motor 14 is fixed to the partition 9 on its surface 45 exposing to the outside air compartment B through a mounting plate 44. One end of motor shaft 20 extends through the partition 9 and into the inside air compartment A and the blower 10 is fixed to the one end of motor shaft 20. The other end of motor shaft 20 is fixed to a propeller fan 22, FIG. 2.

By the blower 10, room air is introduced through an inlet 23 and discharged to the inside heat exchanger 12. The drain pan 13 is positioned higher than the base 8 and a drainage portion 24 is confronted against the outside air compartment B so that drain collected in the drain pan 13 drops on the base 8 of the outside air compartment B.

Figure 4:
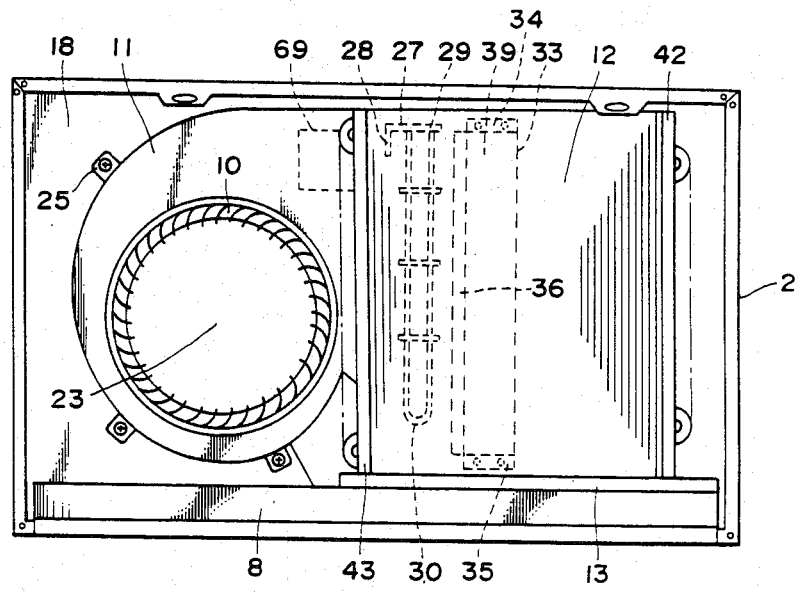
FIG. 4 is a descriptive illustration of the air conditioner showing a front portion of the air conditioner.
Figure 5:
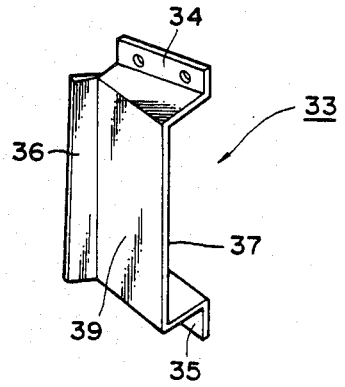
FIG. 5 is a perspective view of an air guide having front and rear blades according to an embodiment of the present invention.
Figure 6:
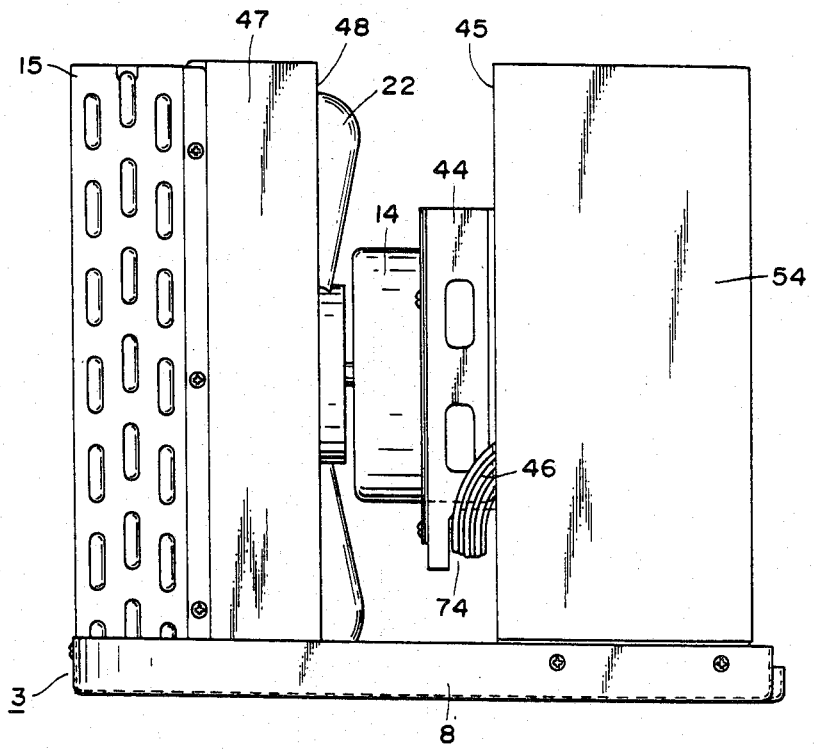
FIG. 6 is a side view of an air conditioning unit according to another embodiment of the air conditioner with a drain shield being removed for clarification.

In the inside air compartment A, the casing 11 of the blower 10, which is formed of metal plate, is fixed to the partition 9 by screws 25 through a casing portion 18 of the heat insulating materials 17 (FIG. 4). The casing 11 has an outlet 26 formed on its right-hand side. A heater mounting plate 27 is fixed to the partition 9 through a duct portion 19 of the heat insulating materials 17 and has an L-shaped configuration having a flange 28 extending vertically and a plate 29 extending horizontally. An electric heater 30 is fixed to the plate 29 in a U-shaped configuration with an opened portion as illustrated in FIG. 3.

A heater protector 32 is secured at an upstream of the heater 30, and positioned adjacent to the flange 28 of the heater mounting plate 27. Air flow discharged from the outlet 26 is partly interrupted to facilitate detection of unusual heating of the heater 30 by the heat protector 32.

Reference numeral 31 represent an air passage, in which an air guide 33 is disposed as illustrated in FIG. 3. The air guide 33 has a height approximately equal to the height of inside heat exchanger 12 (FIG. 4). The air guide 33 has an upper end 34 and a lower end 35, which are fixed to the partition 9 through the heat insulating materials 19. When the air guide 33 is secured in position in the air passage 31, a front or upstream plate (front blade) 36 is located at downstream or the opened portion of the U-shaped electric heater 30, and a rear or downstream plate; rear blade 39 is provided such that its rear end 37 is located adjacent to an upstream portion of the inside heat exchanger 12. The rear blade 39 of the air guide 33 is inclined such that a distance between a rear blade 39 and the partition 9 becomes larger as it extends towards the heat exchanger 12. The air passage 31 is divided into an outside passage 40 and an inside passage 41 by the air guide 33. In the illustrated embodiment, an angle X between the partition 9 and the heat exchanger 12 is about 20°, and an angle Y between the rear blade 39 and the heat exchanger 12 is about 35°. Further, an angle Z between the front blade 36 and the rear blade 39 is about 146°.

The heat exchanger 12 has a right-side tube portion 42 and a left-side tube portion 43 and arranged such that the right-side tube portion 42 is slightly inclined to the inside of the air conditioner 1.

In a heating operation of the air conditioner 1, the heater 30 is switched on and the inside heat exchanger 12 is worked as a condenser, and the blower 10 is driven to rotate. At this moment, an air flow is discharged in a substantially uniform distribution of wind velocity from the outlet 26 of the fan casing 11.

However, provision of the partition 9 for directing the air flow from the outlet 26 to the heat exchanger 12 results in that the majority of the air flow passes through a deep portion of the air passage 31 (i.e., right-hand side in FIG. 3) in a strong flow or a high air pressure distribution, and only a small air flow passes through the other portion, which is adjacent to the outlet 26 of the fan casing 11 (i.e., left-hand side in FIG. 3), in a weak flow or a low air pressure distribution. Consequently, the air flow discharged from the heat exchanger 12 is weak at the left-hand side portion in FIG. 3 which is adjacent to the inlet 23 of the fan casing 11 and strong at the right-hand side portion in FIG. 3 which is distal to the inlet 23. In a heating operation of the air conditioner, at which the eletric heater 30 is operated, a heated air is flowing more at the right-hand side (FIG. 3) of the heat exchanger 12 and, on the other hand, a heated air is flowing less on the left-hand side of the heat exchanger 12, resulting in a detrimental, unbalanced and local heating of the outlet grill 7 on a front surface of the heat exchanger 12.

In the present invention, the discharged air heated by the heater 30 is divided by the front blade 36 of the air guide 33 to pass through the passage 40 and the passage 41. An air flow passing through the passage 40 is directed to one part (namely, right hand side in FIG. 3) of the heat exchanger 12 and the air flow passing through the passage 41 is directed to other part (left hand side in FIG. 3) of the heat exchanger 12. Thus, the air guide 33 minimizes a deviation of wind velocity distribution of air flow in the air passage 31 and facilitates to forcibly send the room air to the heat exchanger 12 to heat the air, which is in turn discharged from the outlet grill 7. At this moment the heated air is not locally concentrated at any part of the outlet grill 7, but uniformly dispersed and, therefore, there is not danger of deformation, warping or cracking of the plastic outlet grill 7. Inventors' experiment shows that provision of the air guide 33 lowers the highest temperature of the discharged air by about 8° C. in comparison with an air stream discharged from the similar unit without the air guide 33 and temperature distribution of the discharged air is uniformed.

In cooling operation, the inside heat exchanger 12 is actuated as an evaporator with the heater 30 being switched off, and the blower 10 is driven so that cooled air is discharged from the outlet grill 7. The experiment shows further that the air guide 33 improves cooling capacity by about 1.5% and permits decrease of power input by about 0.8% and of driving current by about 1.4%. The improvement described above seems to result from the fact that air stream is uniformly discharged into the inside heat exchanger 12 by the air guide 33, and the efficiency of heat transfer of the heat exchanger 12 is improved.

In the outside air compartment B, the fan motor 14 is secured to an outside air compartment side 45 of the partition 9 by means of the mounting plate 44, which plate is cut out at its lower end to form a notch 74 for holding therein a lead wire 46 of the motor 14 so that a distance between the lead wires 46 and the base 8 is maintained larger.

On the upstream of the outside heat exchanger 15, a fan casing 47 having plate (not shown) at its upper end and an opening 48 at which the aforementioned propeller fan 22 is positioned. The propellar fan 22 has a slinger ring 49 around its circumference to take up a drain collected in a secondary receiving portion 62 of the base 8 when the slinger ring 49 is rotated together with the propeller fan 22. By rotation of propeller fan 22, the outside air is drawn from a portion 50 and directed into the outside heat exchanger 15, FIG. 2.

Figure 7:
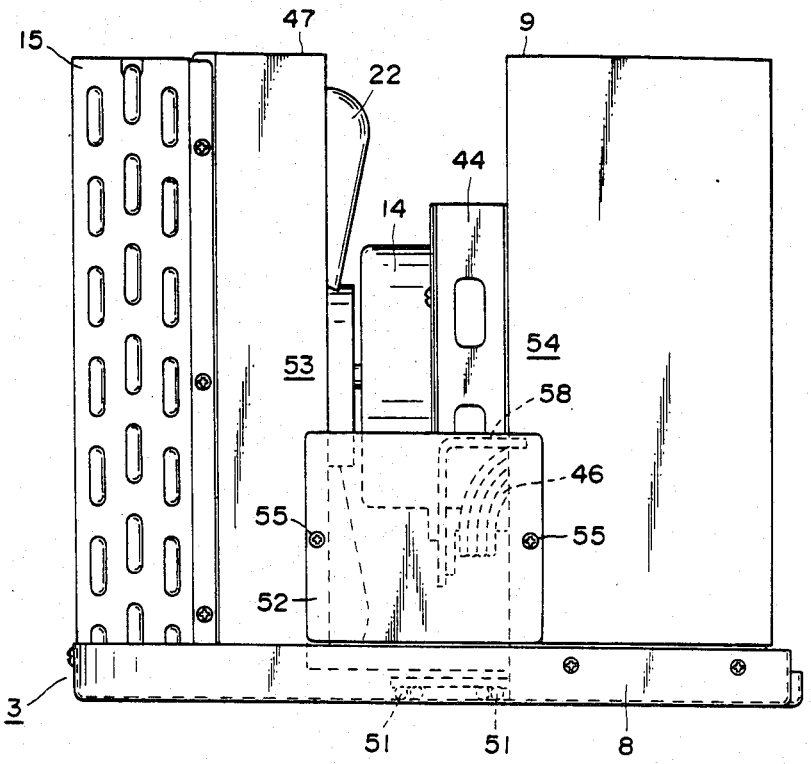
FIG. 7 is a side view of the air conditioning unit shown in FIG. 6, showing the drain shield attached.

In FIG. 7, reference numeral 51 represent a supercooling pipe for flowing therein a refrigerant from the outside heat exchanger 15 at the time of cooling operation so as to cool the refrigerant in the pipe 51 by the drain which is collected the base 8.

Figure 8:
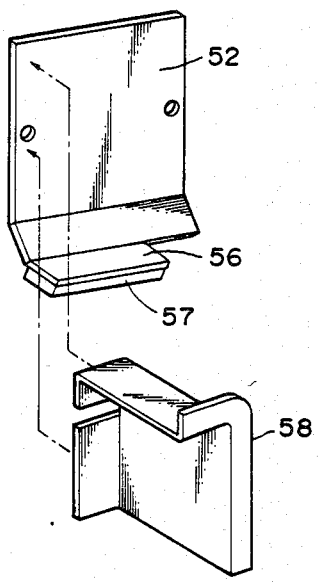
FIG. 8 is a perspectivew view of the drain shield and a protective plate.
Figure 9:
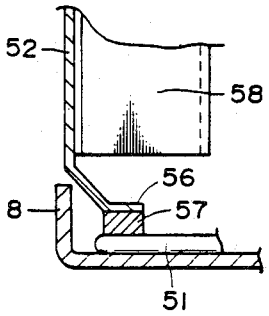
FIG. 9 is a sectional view of the drain shield, showing positional relation with other elements.

A drain receiver 52 is fixed by screws to a side 53 of the fan casing 47 and a side 54 of the partition 9 to close a gap between the two elements 47 and 9. The drain receiver 52 has a bent portion 56 at its lower end, a shock absorbing pad 57, and a protection member 58 which is to be fixed to the drain receiver 52, as illustrated by chain lines with arrows in FIG. 8. When the drain receiver 52 is fixed in position bridging the fan casing 47 and the partition 9, the lead wires 46 is covered by the protection member 58 as shown in FIG. 7 and the supercooling pipe 51 is held by the shock absorbing pad 57 as shown in FIG. 9.

By the construction described above, drain collected in the secondary receiving portion 62 of the base 8 is taken up and splayed upon the outside heat exchanger 15. At this moment, the drain is attached also to a lower inner wall of the opening 48 of the fan casing 47, and the drain is delivered along the inner wall of the opening 48 by rotation of the fan 22 and splashed out of the opening 48. Then the splashed drain abuts against the drain receiver 52 and flows down along the drain receiver 52 and the protection member 58 and thereafter is directed to the supercooling pipe 51 and the base 8. Thus, the structure, in which an end of the base 8 and the lead wires 46 are covered by the drain receiver 52 and the protection member 58, prevents the drain from dropping onto any portion out of the base 8 and attaching to the lead wires 46 of the fan motor 14.

Figure 10:
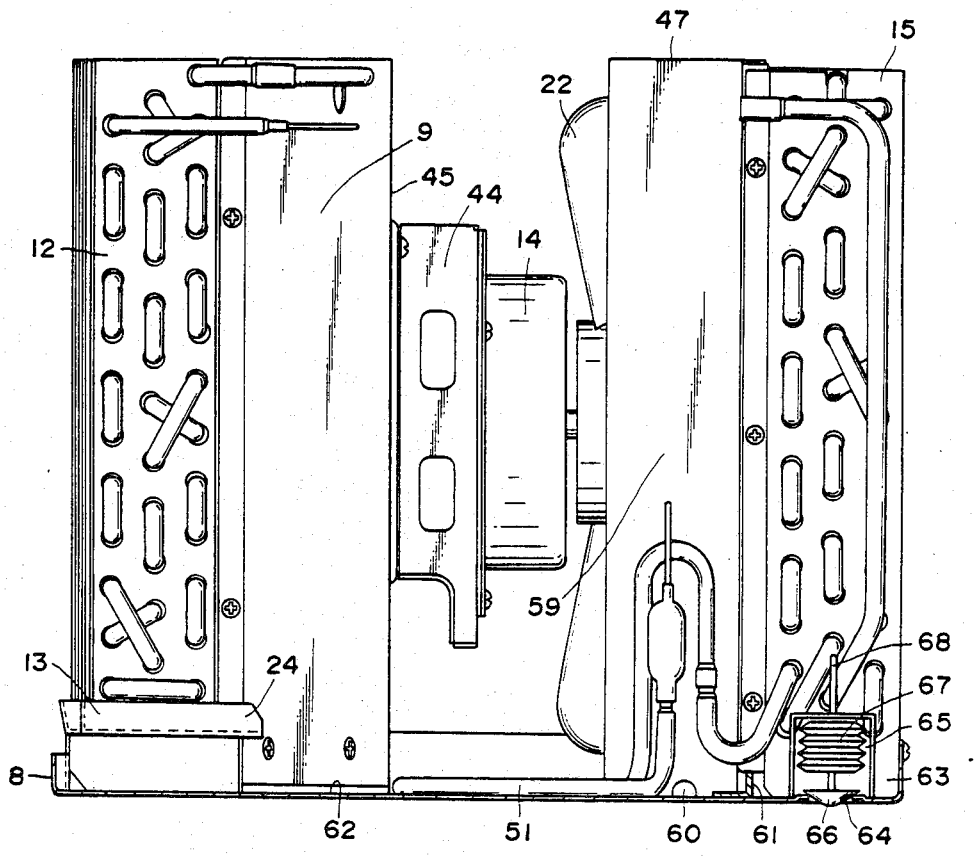
FIG. 10 is another side view of the air conditioner with a compressor being removed for clarification.

With reference to FIG. 10 in which the compressor 16 is not shown for clarification, the fan casing 47 has at its lower end a notch 60 adjacent to the compressor 16 (FIG. 2) so that the drain is directed to the base 8 in the fan casing 47. A divider 61 extends from left to right of the base 8 and provides a primary receiving portion 63 in which the outside heat exchanger 15 is located and the secondary receiving portion 62 in which the fan casing 47 and the slinger ring 49 are located. The primary receiving portion 63 has a discharge opening 64 having a discharge valve 65. The valve 65 has an elastomeric valve body 66, bellows 67 for activating the valve body 66 and a temperature sensitive portion 68. The temperature sensitive portion 68 detects an outside temperature around the base 8 and, if this temperature is below about 15° C., a gas in the bellows 67 is decreased to move the valve body 66 upward to open the discharge opening 64 and if the temperature is above about 15° C., the valve body 66 closes the discharge opening 64.

By the construction described above, in a cooling operation, a water or the drain dropped from the inside heat exchanger 12 is received by the drain pan 13 and directed to the secondary receiving portion 62 through the drainage portion 24. The drain is moved to the secondary receiving portion 62 of the fan casing 47 through the recess 60 of the fan casing 47 and taken up and splayed onto the outside heat exchanger 15. When the water level of the drain becomes higher than the divider 61, the drain flows over the divider 61 into the primary receiving portion 63. In a cooling operation the outside air temperature hardly becomes 15° C. or less and the discharge opening 64 is closed by the valve body 66 and, therefore, there is almost no danger of flowing of the drain from the discharge opening 64.

On the other hand, at the time of heating or otherwise defrosting operation, the drain dropped from the outside heat exchanger 15 is reveived by the primary receiving portion 63. When the outside temperature is below 15° C., the discharge opening 64 is closed by the valve 65 and, accordingly, the drain drops from the discharge opening 64.

In the embodiment described above, the discharge valve 65 is controlled by the outside air temperature around the base 8. Alternatively, the discharge valve 65 may be controlled by directly detecting the temperature of the drain. Further, the drain collected in the secondary receiving portion 62 is sucked by using a pump and the like rather than the slinger ring 49 so that it is splayed onto the outside heat exchanger 15.

Although the present invention has been described with reference to the preferred embodiments thereof, many modifications and alterations can be made within the spirit of the present invention.

What is claimed is:

1. Air conditioner comprising:

a blower for introducing a room air from an inlet grill and discharging the room air from an outlet grill to a room, a heat exchanger, mounted adjacent to an inner surface of said outlet grill, for cooling the room air introduced from said inlet grill in a cooling operation and heating said air in a heating operation, an electric heater for heating said air in the heating operation, a flat member forming an air passage between said heat exchanger and said blower for guiding the air flow discharged from said blower to said heat exchanger, and positioned at the back of said heat exchanger and connecting straightly an end of said blower to an end of said heat exchanger, said electric heater being secured in said air passage for heating air discharged by said blower, an air guide means, mounted in position in said passage, for guiding the heated air flow in a uniform manner to minimize a deviation of air flow distribution in said air passage, wherein said air guide means has a front blade projecting toward said electric heater such that the heated air flow is divided into two parts and a rear blade extending with prescribed angles from said front blade toward said heat exchanger in an inclined relation relative to said flat member such that a distance between said rear blade and said flat member becomes larger as said rear blade extends towards said heat exchanger and a rear end of said rear blade lies near to said heat exchanger.

2. Air conditioner according to claim 1, further comprising a front panel, said front panel having an inlet grill and an outlet grill on the same plane thereof.

3. Air conditioner according to claim 1, wherein said blower is a centrifugal blower.

4. Air conditioner according to claim 1, wherein said electric heater has a U-shape with an opened portion, and wherein said front blade of said air guide means is positioned in a confronting relation with said opened portion of said electric heater.

* * * * *